US005650812A

United States Patent [19]

Ochi et al.

[11] Patent Number: 5,650,812

[45] Date of Patent: Jul. 22, 1997

[54] RECORDING HEAD FOR PREVENTIVE AIR INTRUSION INTO THE COMMON CHAMBER

[75] Inventors: Norihiro Ochi, Yamato-Koriyama; Hisashi Yoshimura, Nara; Yoshio Kanayama, Nabari, all of Japan

[73] Assignee: Sharp Kabushiki Kaisha, Osaka, Japan

[21] Appl. No.: 372,862

[22] Filed: Jan. 13, 1995

Related U.S. Application Data

[63] Continuation of Ser. No. 70,993, Jun. 4, 1993, abandoned.

[30] Foreign Application Priority Data

Jun. 9, 1992 [JP] Japan ..... 4-149184

[51] Int. Cl.[6] ..... B41J 2/19

[52] U.S. Cl. ..... 347/92

[58] Field of Search ..... 347/44, 68, 92–94, 347/47, 21, 70

[56] References Cited

U.S. PATENT DOCUMENTS

| | | | |
|---|---|---|---|
| 4,158,847 | 6/1979 | Heinzl et al. | 347/68 |
| 4,380,018 | 4/1983 | Andoh et al. | 347/68 |
| 4,882,596 | 11/1989 | Tsuzuki et al. | 347/68 |

FOREIGN PATENT DOCUMENTS

| | | | |
|---|---|---|---|
| 2543451 | 3/1977 | Germany . | |
| 58-112748 | 7/1983 | Japan . | |
| 2-1323 | 1/1990 | Japan | B41J 2/135 |
| 4-355146 | 12/1992 | Japan | B41J 2/055 |

*Primary Examiner*—Alrick Bobb

[57] ABSTRACT

A recording head for an ink-jet printer has a plurality of holes disposed in a base portion of each of a plurality of ink-jet nozzles and has an ink discharging orifice disposed at an end tip of each of the ink-jet nozzles. Each of the holes has a diameter smaller than that of the ink discharging orifice. In this recording head for an ink-jet printer, when the supply of ink to a common ink chamber is interrupted, it is possible to stop the air flowed into the recording head in an intermediate portion of an intake path of the air so that the cost of running the recording head can be reduced.

4 Claims, 6 Drawing Sheets

RECORDING HEAD FOR PREVENTIVE AIR INTRUSION INTO THE COMMON CHAMBER

This application is a continuation of application Ser. No. 08/070,993 filed on Jun. 4, 1993, now abandoned.

BACKGROUND OF THE INVENTION

1. Field of the Invention

The present invention relates to a recording head for an ink-jet printer.

2. Description of the Related Art

A former recording head for an ink-jet printer has a common ink chamber communicated with an ink cartridge and has a plurality of ink-jet nozzles connected in parallel to the common ink chamber. The interior of each of the ink-jet nozzles is communicated with the common ink chamber. A hole is formed in a base portion of each of the ink-jet nozzles to secure a flow rate of ink discharged to the exterior of each of the ink-jet nozzles. The hole has a diameter larger than a diameter of an ink discharging orifice disposed at an end tip of each of the ink-jet nozzles.

In the above former recording head, when the supply of ink from the ink cartridge to the common ink chamber is interrupted and a printing operation is further performed continuously, air is flowed into an interior of a certain ink-jet nozzle among the plural ink-jet nozzles through the ink discharging orifice of this ink-jet nozzle. At this time, the other ink-jet nozzles except for this ink-jet nozzle having the intake air robs this ink-jet nozzle of its ink and continuously discharges this ink. Accordingly, air is further flowed into this ink-jet nozzle having the intake air. As a result, the ink-jet nozzle having the intake air has an amount of the air sufficient to make the air reach into a deep portion of this ink-jet nozzle.

No former recording head has a means for preventing the air from being further flowed into the deep portion in an intermediate portion of an intake path of the air within the recording head. Therefore, the air is flowed into the common ink chamber so that the ink-jet nozzle falls into a condition to be difficult or impossible to return its function to the original state.

The former recording head for an ink-jet printer will next be described with reference to FIGS. 4*a* to 6 to clarify the principle of a recording head in the present invention.

FIG. 4*a* is an explanatory view for showing the relation in position between a recording head 2 and an ink cartridge 3 in an ink-jet printer 1. FIG. 4*b* is a transverse cross-sectional view of the ink-jet printer shown in FIG. 4*a*.

As shown in FIGS. 4*a*and 4*b*, the ink-jet printer 1 is constructed by the recording head 2 and the ink cartridge 3. The ink cartridge 3 is connected to the recording head 2 through a flowing passage of ink. The recording head 2 has a common ink chamber 4 and a plurality of ink-jet nozzles 5 connected in parallel to the common ink chamber 4. In the former printer, a hole 7 is disposed in a connection portion between the common ink chamber 4 and each of the ink-jet nozzles 5 to secure a flow rate of ink such that a diameter of this hole 7 is larger than that of an ink discharging orifice 6.

An oscillator disposed in each of the ink-jet nozzles 5 is omitted in FIG. 4*b*.

FIG. 5 is a cross-sectional view taken along line A—A of FIG. 4*b*. An ink supply port 8 is disposed in the common ink chamber 4 and is communicated with the ink cartridge 3. The hole 7 is formed in a base portion of each of the ink-jet nozzles 5 to flow ink taken into the common ink chamber 4 through the ink supply port 8 to each of the ink-jet nozzles 5. An oscillator 9 is arranged within each of the ink-jet nozzles 5 to discharge the ink flowed into each of the ink-jet nozzles 5 through the hole 7 to the exterior of each of the ink-jet nozzles 5 through the ink discharging orifice 6.

FIGS. 6*a*, 6*b* and 6*c* are views for schematically showing the flowing processes of the air flowed into the recording head for an ink-jet printer when the supply of ink from an ink cartridge is interrupted in the former recording head. No oscillator is illustrated in FIGS. 6*a* 6*b* and 6*c*.

As shown in FIG. 6*a*, when the supply of ink from the ink cartridge is interrupted and a printing operation is further performed continuously, the air is flowed into a certain ink-jet nozzle 5 through an ink discharging orifice 6 thereof. This certain ink-jet nozzle 5 is set to the second ink-jet nozzle from the left-hand side in FIG. 6*a*. (Reference numeral 30 designates ink.) The other ink-jet nozzles except for this ink-jet nozzle 5 having the intake air robs this ink-jet nozzle of its ink and continuously discharges this ink. Therefore, as shown in FIG. 6*b*, the air is flowed into a deeper portion of this second ink-jet nozzle 5. In the former ink-jet nozzle, a diameter of the hole 7 is set to be larger than that of the ink discharging orifice 6. Accordingly, it is impossible to prevent the intake air from being further flowed into this ink-jet nozzle 5. Therefore, as shown in FIG. 6*c*, the intake air within this ink-jet nozzle 5 is further flowed into the common ink chamber 4 so that this ink-jet nozzle 5 falls into a condition to be difficult or impossible to return its function to the original state.

To avoid such a state, it is necessary to detect a remaining amount of ink within the ink cartridge and stop the printing operation when this remaining amount is small.

SUMMARY OF THE INVENTION

It is therefore an object of the present invention to provide a recording head for an ink-jet printer in which, when the supply of ink to a common ink chamber is interrupted, it is possible to stop the air flowed into the recording head in the interior of an ink-jet nozzle in an intermediate portion of an intake path of the air so that the ink-jet nozzle can easily be returned to its function and the cost of the ink-jet printer can be reduced.

The above object of the present invention can be achieved by a recording head for an ink-jet printer comprising a common ink chamber for storing ink supplied from an ink cartridge; and a plurality of ink-jet nozzles for receiving ink flowed from the common ink chamber and connected in parallel to the common ink chamber to discharge the received ink from the ink-jet nozzles; the recording head being characterized in that each of the ink-jet nozzles has a plurality of holes disposed in a base portion of each of the ink-jet nozzles to communicate the common ink chamber with the interior of each of the ink-jet nozzles; and an ink discharging orifice for discharging the received ink to the exterior of each of the ink-jet nozzles and disposed at an end tip of each of the ink-jet nozzles; each of the holes has a diameter smaller than that of the ink discharging orifice; and the number of the holes is determined such that a predetermined flow rate of the discharged ink can be secured.

In the recording head for an ink-jet printer in an embodiment of the present invention, a pressure within the recording head is set to be negative when the supply of ink from an ink cartridge to the common ink chamber is interrupted. The atmospheric air is flowed into the interior of one ink-jet nozzle among the plural ink-jet nozzles through the ink discharging orifice of this ink-jet nozzle. The interior of this ink-jet nozzle is gradually filled with the flowed air. The diameter of a hole formed in a base portion of the ink-jet nozzle is set to be smaller than that of the ink discharging orifice of each of the ink-jet nozzles in the recording head for an ink-jet printer in the present embodiment. Accordingly, the surface tension of ink in the hole formed in the base portion of the ink-jet nozzle filled with the above air can balance with force provided by a negative pressure within the common ink chamber. However, no surface tension of ink in the ink discharging orifice of the other ink-jet nozzles except for the ink-jet nozzle filled with the above air can be set to be stronger than force provided by a negative pressure within the other ink-jet nozzles. Accordingly, the air is flowed into the other ink-jet nozzles at an air intake stage next to an air intake stage of the above one ink-jet nozzle filled with the air. Thus, it is possible to completely prevent the air from being flowed into the common ink chamber from the ink-jet nozzle filled with the above air.

As explained above in detail, the recording head for an ink-jet printer in the present embodiment has a plurality of holes disposed in a base portion of an ink-jet nozzle and has an ink discharging orifice disposed at an end tip of this ink-jet nozzle. Each of the above holes has a diameter smaller than that of the ink discharging orifice. Accordingly, when the supply of ink to the common ink chamber is interrupted, the air flowed into the recording head can be stopped in the interior of an ink-jet nozzle. Thus, it is possible to prevent the air from being flowed into the common ink chamber so that the ink-jet nozzle can easily be returned to its function which reduces waste of the ink and reduce the running cost of the recording head. Further, the recording head of the present embodiment can easily be returned to its function even when the air is flowed into an ink-jet nozzle. Consequently, it is not necessary to detect a remaining amount of ink within an ink cartridge so that no detector for detecting this remaining amount is required. Therefore, the recording head of the present embodiment contributes to reducing the cost of the main body of the ink-jet printer.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of a recording head for an ink-jet printer in the present invention will next be described in detail with reference to the accompanying drawings.

Figure 1:
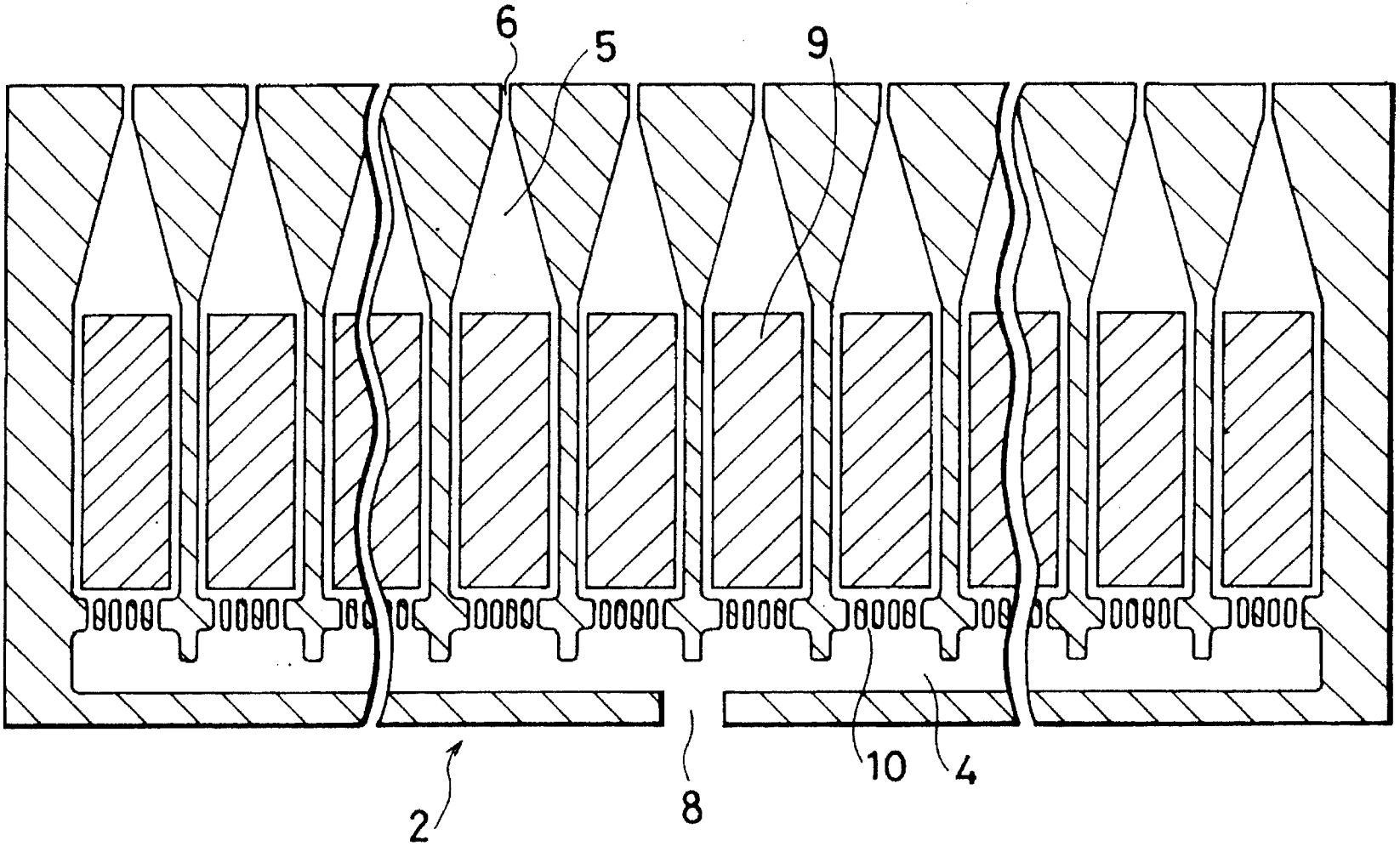
FIG. 1 is a cross-sectional view showing a recording head for an ink-jet printer in accordance with one embodiment of the present invention.
Figure 4A:
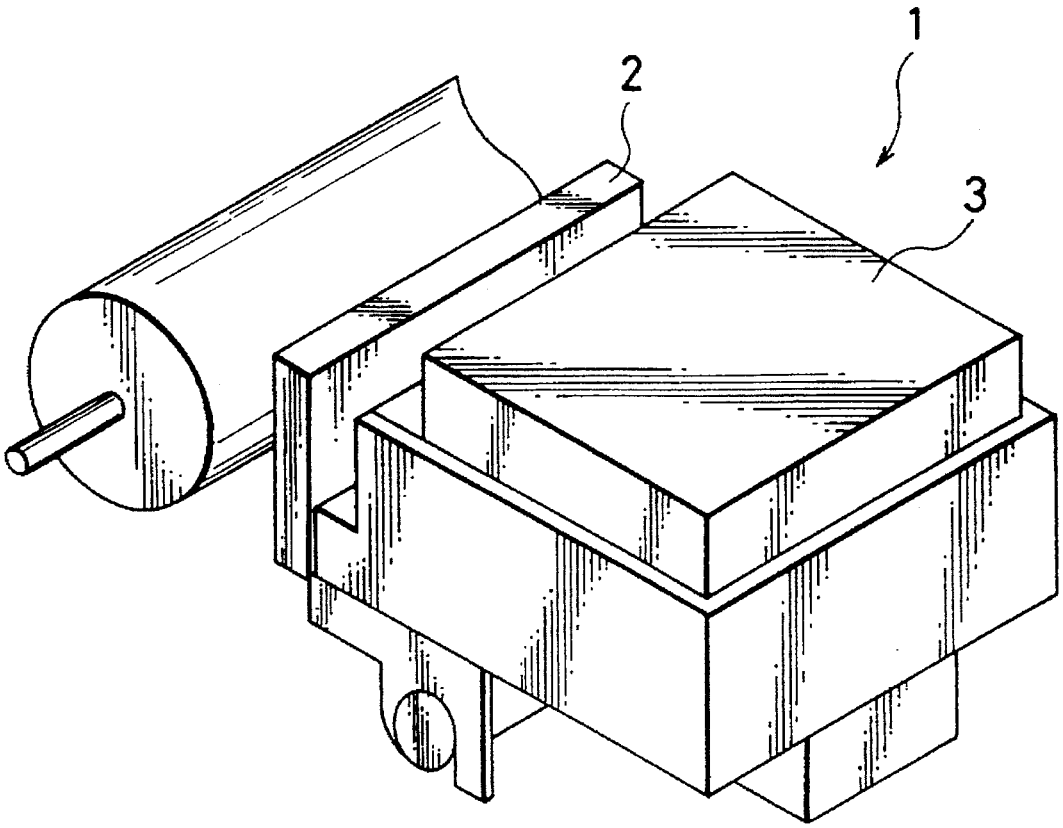
Fig.4a PRIOR ART
FIG. 4*a*is a view showing the relation in positions between a former recording head for an ink-jet printer and an ink cartridge.
Figure 4B:
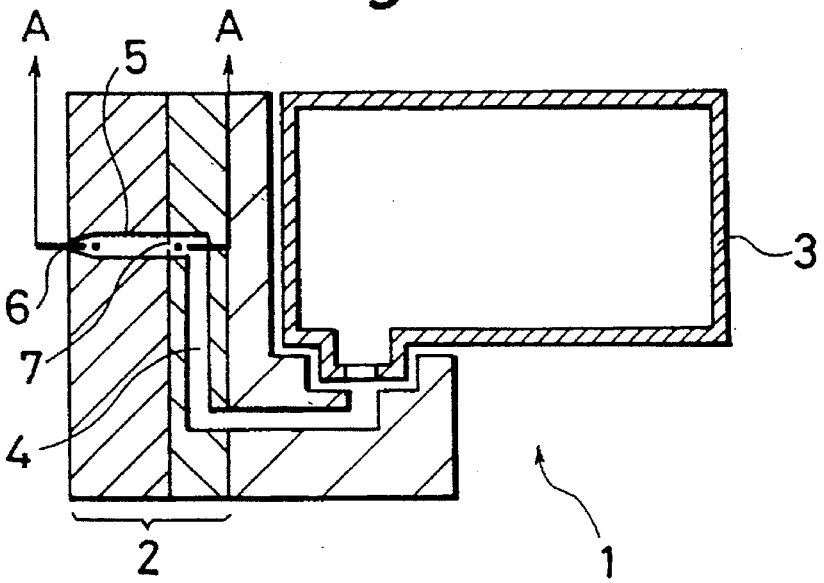
Fig.4b PRIOR ART
FIG. 4*b*is a transverse cross-sectional view of the ink-jet printer shown in FIG. 4*a;*
Figure 5:
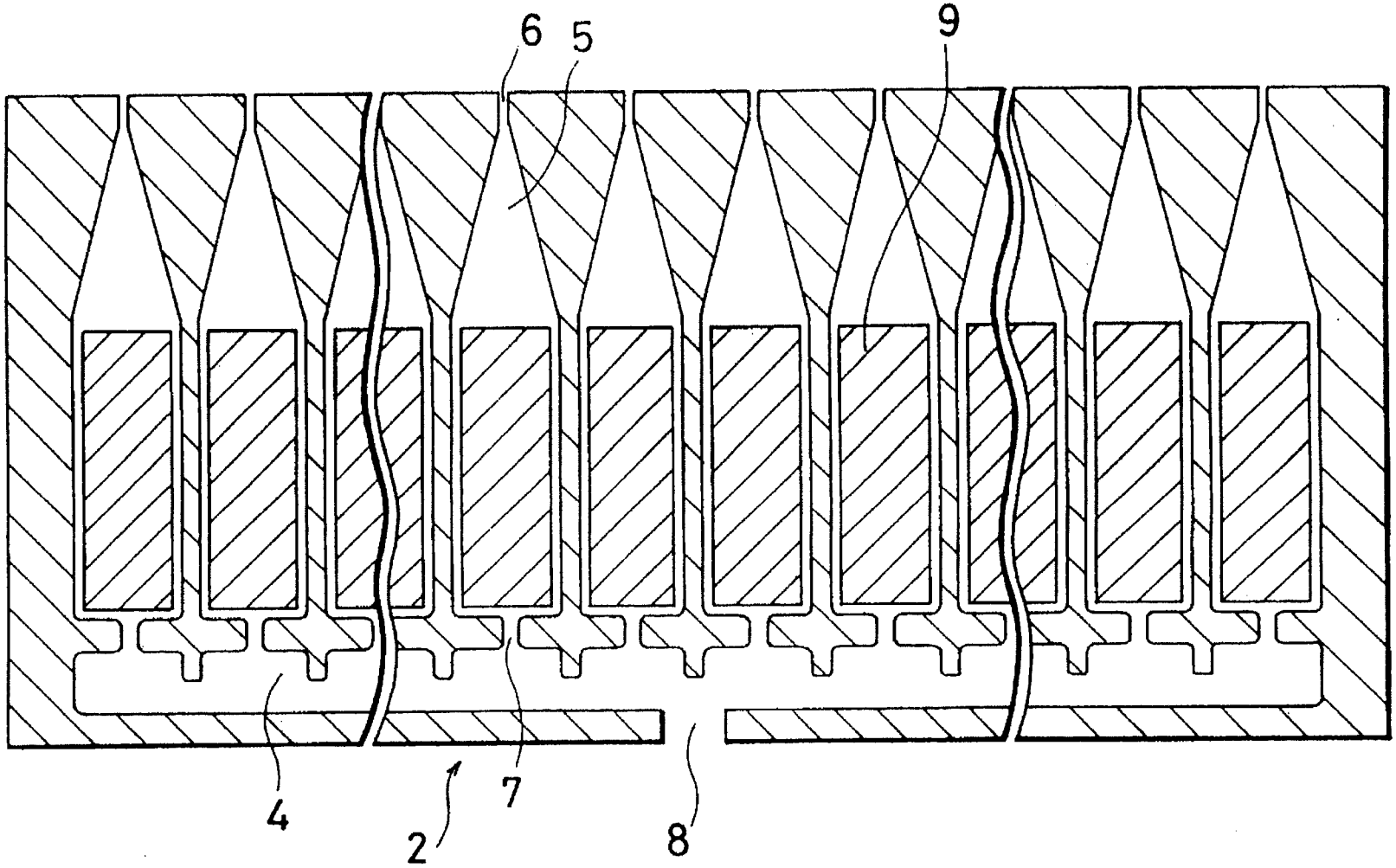
Fig. 5 PRIOR ART
FIG. 5 is a cross-sectional view taken along line A—A of FIG. 4*b;*
Figure 6A:
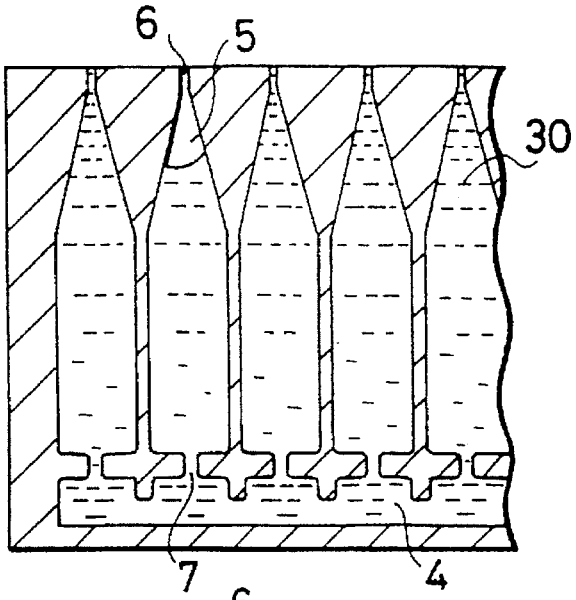
Fig.6a PRIOR ART
FIG. 6*a* is an explanatory view showing a first stage of a flowing process of the air flowed into the former recording head for an ink-jet printer.
Figure 6B:
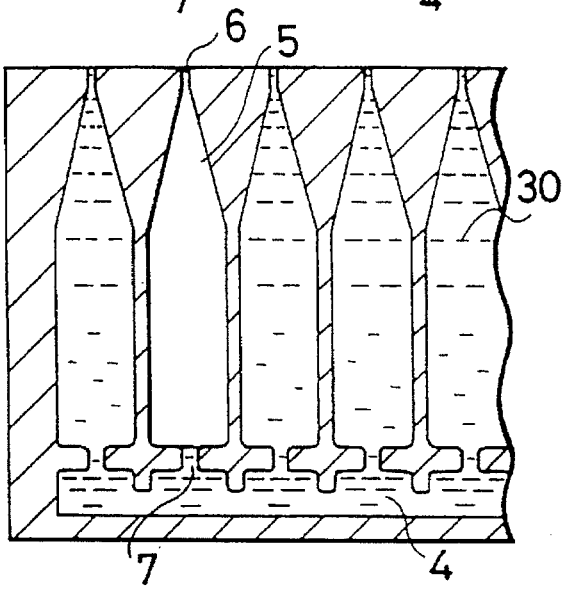
Fig.6b PRIOR ART
FIG. 6*b* is an explanatory view showing a second stage of the flowing process of the air flowed into the former recording head for an ink-jet printer.
Figure 6C:
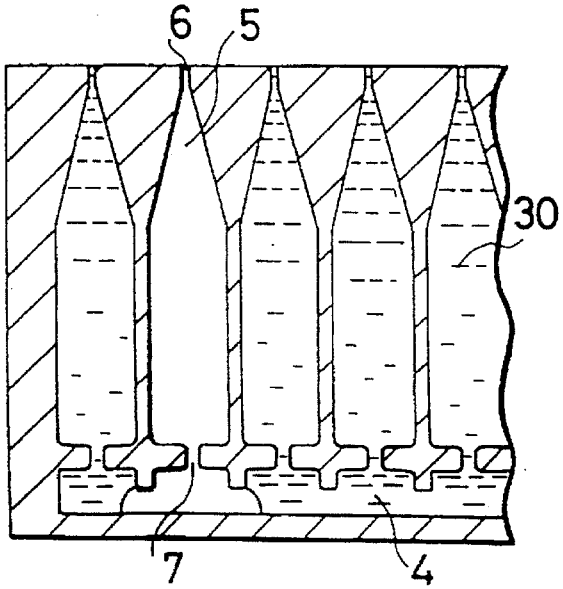
Fig.6c PRIOR ART
FIG. 6*c* is an explanatory view showing a third stage of the flowing process of the air flowed into the former recording head for an ink-jet printer.

FIG. 1 shows a recording head for an ink-jet printer in accordance with one embodiment of the present invention. FIG. 1 corresponds to a cross-sectional view taken along line A—A of FIG. 4*b*.

As shown in FIG. 1, a recording head 2 has a common ink chamber 4 and a plurality of ink-jet nozzles 9. The common ink chamber 4 has an ink supply port 8 for communicating the common ink chamber 4 with an ink cartridge. A plurality of holes 10 are disposed in a base portion of each of the ink-jet nozzles 5. Each of the holes 10 has a diameter smaller than that of an ink discharging orifice 6. An oscillator 9 is arranged within each of the ink-jet nozzles 5 to discharge ink flowed into each of the ink-jet nozzles 5 through the plural holes 10 to the exterior of each of the ink-jet nozzles 5 through the ink discharging orifice 6.

Figure 2A:
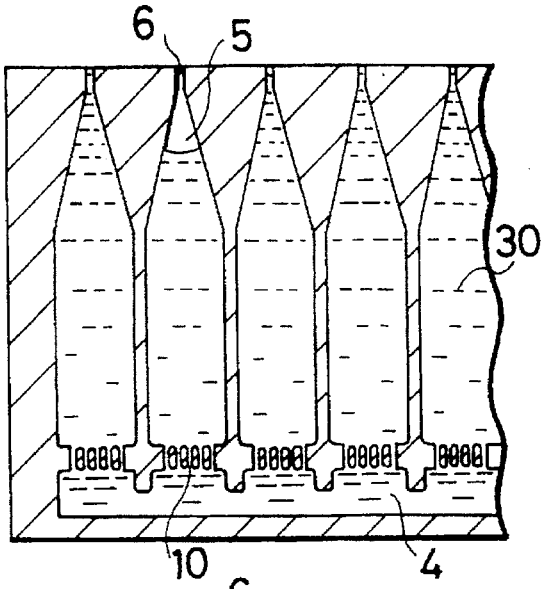
FIG. 2*a* is an explanatory view showing a first stage of a flowing process of the air flowed into the recording head for an ink-jet printer in an embodiment of the present invention.
Figure 2B:
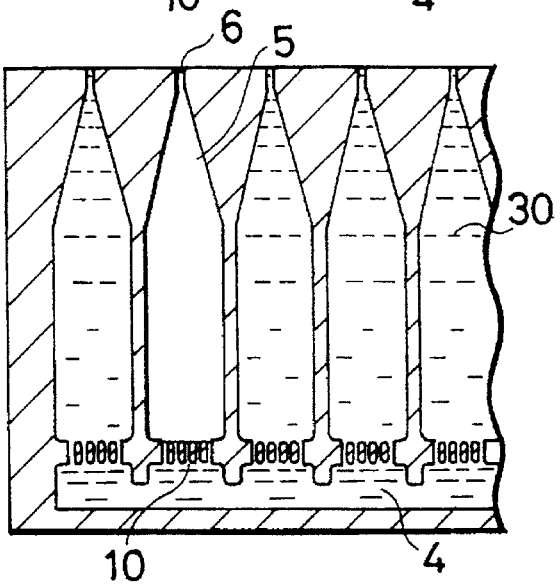
FIG. 2*b* is an explanatory view showing a second stage of the flowing process of the air flowed into the recording head for an ink-jet printer in the an embodiment of present invention.
Figure 2C:
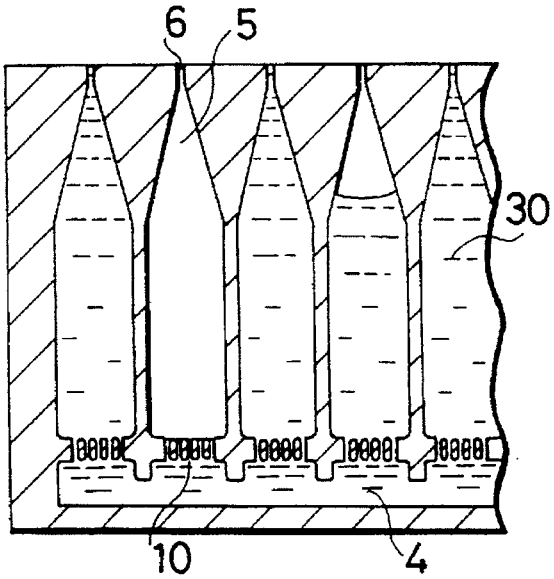
FIG. 2*c* is an explanatory view showing a third stage of the flowing process of the air flowed into the recording head for an ink-jet printer in an embodiment of the present invention.

As shown in FIGS. 2*a*, 2*b* and 2*c*, when the supply of ink from the ink cartridge is interrupted in the recording head 2 in this embodiment, the plural holes 10 disposed in the base portion of each of the ink-jet nozzles 5 prevent the air taken into the interior of each of the ink-jet nozzles 5 from being flowed into the common ink chamber 4. In FIGS. 2*a*, 2*b* and 2*c*, reference numeral 30 designates ink stored within the recording head 2.

As shown in FIG. 2*a*, if the supply of ink from the ink cartridge is interrupted, the air is flowed into the interior of a certain ink-jet nozzle 5 among the plural ink-jet nozzles through an ink discharging orifice 6 of this certain ink-jet nozzle 5 by operating an unillustrated oscillator continuously. This certain ink-jet nozzle 5 is set to the second ink-jet nozzle from the left-hand side in FIG. 2*a*. Thereafter, the ink is continuously discharged from each of the other ink-jet nozzles except for the certain ink-jet nozzle 5 having the intake air while each of the other ink-jet nozzles robs this certain ink-jet nozzle 5 of its ink. Thus, as shown in FIG. 2*b*, the second ink-jet nozzle 5 from the left-hand side is completely filled with the air.

In an air filling state shown in FIG. 2*b*, there is a possibility that the air within the certain ink-jet nozzle 5 is flowed into the common ink chamber 4 through each of the holes 10 disposed in the base portion of the certain ink-jet nozzle 5. Otherwise, there is a possibility that the air is newly flowed into each of the other ink-jet nozzles except for the certain ink-jet nozzle 5 filled with the air through an ink discharging orifice of each of the other ink-jet nozzles. These possibilities depend on the size of a diameter between the ink discharging orifice of each of the other certain ink-jet nozzles except for the ink-jet nozzle 5 filled with the air and each of the holes disposed in the base portion of this certain ink-jet nozzle 5. Concretely, these possibilities are determined by the power between capillary forces caused in the ink discharging orifice and capillary force caused in each of the holes 10.

In the recording head 2 in this embodiment, the diameter of each of the holes 10 is set to be smaller than that of the ink discharging orifice 6. Accordingly, as shown in FIG. 2*c*, the air is newly flowed into the other ink-jet nozzles except for the certain ink-jet nozzle 5 filled with the air at an air intake stage next to the air intake stage shown in FIG. 2*b*. The other ink-jet nozzle is set to the fourth ink-jet nozzle from the left-hand side in FIG. 2*c*. Accordingly, a situation does not exist in which air within the second ink-jet nozzle 5 filled with the air is flowed into the common ink chamber 4.

In the recording head in the present embodiment, it is preferable to form the ink discharge orifice 6 and each of the holes 10 so as to have a following relation of their size 0.9 R≧r when R is a diameter of the ink discharge orifice 6 and r is a diameter of the hole 10.

Further, the ink discharge orifice 6 is preferably not more than 50 μm in diameter.

When the diameter of the ink discharging orifice 6 in the recording head 2 in this embodiment is set to 36 μm, it is preferable to dispose 6 to 12 holes each having a diameter of 20 μm to 30 μm in the base portion of an ink-jet nozzle 5.

Figure 3:
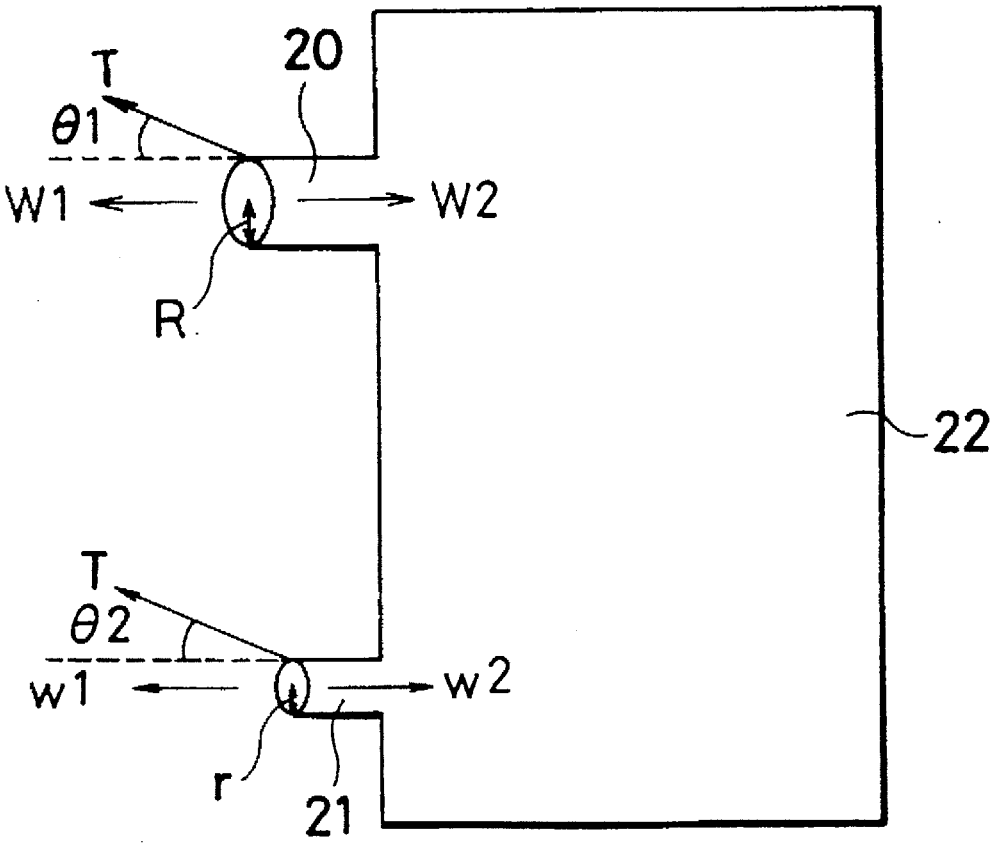
FIG. 3 is a view for explaining the principle of the recording head for an ink-jet printer in an embodiment of the present invention.

In FIG. 3, which explains a flowing principle of this air, showing the recording head 2 of the present invention, the air taken into an ink-jet nozzle is not flowed into the common ink chamber through a hole disposed in a base portion of the ink-jet nozzle, but is flowed into the other ink-jet nozzles through an ink discharging orifice thereof.

In FIG. 3, a flowing passage 20 (radius; R) corresponds to a passage within the ink discharging orifice at an end tip of the ink-jet nozzle. A flowing passage 21 (radius; r) corresponds to a passage within the hole disposed in the base point the base portion of the ink-jet nozzle having the intake air. A chamber 22 filled with ink shows a state in which the common ink chamber and the interior of the other ink-jet nozzles having no intake air are filled with ink.

When the supply of ink from an ink cartridge is interrupted and an internal pressure within the chamber 22 filled with ink is equal to a negative pressure (−P), force w1 caused by surface tension and force w2 caused by the internal negative pressure are represented as follows in consideration of balance of these forces on the meniscus of the flowing passage 21.

$$w1=2\pi r\ T\cos\theta 2$$

$$w2=\pi r^2 P$$

In this case, reference numerals T and θ1, θ2 respectively designate surface tension and an angle of contact.

Usually, these forces are balanced. However, when further the negative pressure (−P) becomes in the critical state which the balance of those forces on the meniscus is not kept on, the angle of contact θ2 is represented as θ2 =θb.

Where, θb is the retreated angle of contact, that is, the minimum angle of the angle of contact.

As the meniscus retreats, the angle of contact grows smaller than the above minimum value.

The balance of the forces on meniscus of the flowing passage 21 in the critical state is represented by the following equation (1).

since w1=w2

$$2\pi rT\cos\theta b=\pi r^2 P$$

therefore $$P=2T\cos\theta b/r \quad (1)$$

and each of the forces W1, W2 applied onto the meniscus of the flowing passage 20 is represented by the following equation (2) and (3), $$W1=2\pi RT\cos\theta 1 \quad (2)$$

$$W2=\pi R^2 P \quad (3)$$

from the equation (1), $W_2$ is represented by the following equation (4).

$$W2=2\pi RT\cos\theta b\ R/r+tm\ (4)$$

Here, a value for θ1 satisfies θ1≧θb and the diameter of the ink discharging orifice 6 is set to be larger than that of a hole 10 in the recording head of the present invention, so that R/r >1.

Accordingly, from both of the equations (2) and (4), the result is as follows, W1<W2.

As a result, when the forces provided by the surface tension of ink and the internal negative pressure of the chamber 22 are balanced in the flowing passage 21, the force provided by the surface tension of ink in the flowing passage 20 is weaker than the force provided by the internal negative pressure of the chamber 22. Therefore, the air is not flowed into the chamber 22 through the flowing passage 21, but is flowed into the chamber 22 through the flowing passage 20.

Accordingly, when the pressure of ink within the recording head 2 is reduced, it is possible to prevent the air from being flowed into the common ink chamber through a hole having a small diameter disposed in a base portion of an ink-jet nozzle and the air is flowed into the ink-jet nozzle through an ink discharging orifice having a large diameter.

Many widely different embodiments of the present invention may be constructed without departing from the spirit and scope of the present invention. It should be understood that the present invention is not limited to the specific embodiments described in the specification, except as defined in the appended claims.

What is claimed is:

1. A recording head for an ink-jet printer comprising:

a common ink chamber for storing ink supplied from an ink cartridge;

a plurality of ink-jet nozzles arranged in parallel to one another, each of said ink-jet nozzles having means for generating pressure and having a leading end and a base portion, each of said ink jet nozzles being connected to said common ink chamber at said base portion for discharging said ink from said common ink chamber; and an ink discharging orifice disposed at said leading end of each of said ink-jet nozzles, said base portion having a plurality of holes connecting each of said ink-jet nozzles and said common ink chamber, and preventing air in each of said ink-jet nozzles from entering said common ink chamber, and wherein a ratio of a radius r of each of said holes to a radius R of said ink discharging orifice is not greater than 90% so that, when a pressure of said ink within said recording head is reduced and air is drawn to fill one of said ink nozzles with all other ink-jet nozzles still being filled with ink, the effect of surface tension on an air-ink interface at holes with said radius said r at a base portion of said ink-jet nozzle filled with said air is greater than the effect of surface tension on an air-ink interface at an ink discharging orifice with said radius R at a leading end of ink-jet nozzle still filled with ink, thus preventing said air drawn into said air-filled ink-jet nozzle from entering said ink chamber through said holes at said base portion of said air-filled ink-jet nozzle before each of said ink-jet nozzles is filled with said air.

2. A recording head for an ink-jet printer as claimed in claim 1, wherein a diameter of each said ink discharge orifice is not greater than 50 μm.

3. A recording head for an ink-jet printer as claimed in claim 1, wherein a number of said holes disposed in said base portion ranges from 6 to 12.

4. A recording head for an ink-jet printer as claimed in claim 3, wherein a diameter of each said ink discharge orifice is not greater than 50 μm.

* * * * *